US005101644A

United States Patent [19]

Crum et al.

[11] Patent Number: 5,101,644

[45] Date of Patent: Apr. 7, 1992

[54] CO-ROTATIONAL SCROLL APPARATUS WITH POSITIVE LUBRICANT FLOW

[75] Inventors: Daniel R. Crum; Peter A. Kotlarek, both of La Crosse; Robert E. Utter, Onalaska, all of Wis.

[73] Assignee: American Standard Inc., New York, N.Y.

[21] Appl. No.: 605,597

[22] Filed: Oct. 29, 1990

[51] Int. Cl.[5] ..... F04C 18/04; F04C 29/02

[52] U.S. Cl. ..... 62/498; 418/55.5; 418/55.6; 418/88; 418/94; 418/99; 418/188

[58] Field of Search ..... 418/55.5, 55.6, 88, 418/94, 99, 188; 62/498

[56] References Cited

U.S. PATENT DOCUMENTS

| | | | |
|---|---|---|---|
| 4,477,233 | 10/1984 | Schaefer | 417/366 |
| 4,568,256 | 2/1986 | Blain | 418/55.6 |
| 4,576,555 | 3/1986 | Ashenfelter | 417/372 |
| 4,621,993 | 11/1986 | Nakamura et al. | 418/55.6 |
| 4,840,549 | 6/1989 | Morishita et al. | 418/188 |
| 4,928,503 | 5/1990 | Riffe | 62/498 |
| 4,993,927 | 2/1991 | Eto et al. | 418/55.6 |

FOREIGN PATENT DOCUMENTS

| | | | |
|---|---|---|---|
| 56-20793 | 2/1981 | Japan | 418/55.6 |
| 59-60092 | 4/1984 | Japan | 418/55.6 |

*Primary Examiner*—John J. Vrablik

*Attorney, Agent, or Firm*—William J. Beres; William O'Driscoll; David L. Polsley

[57] ABSTRACT

In a co-rotational scroll apparatus having two interleaving scroll wraps secured to end plates rotating about parallel, non-concentric axes to produce a relative orbital motion, a means for providing positive lubricant flow through the scroll wraps. A sump is provided adjacent the idler scroll member for supplying lubricant to a lubricant pump disposed in the lower end of the shaft of one scroll member. A lubricant gallery is provided in the scroll shaft for receiving the lubricant from the pump and directing the lubricant through passages in the scroll shaft to lubricate the scroll shaft bearing and for directing lubricant to passages in the end plate of the scroll member to be discharged adjacent the outer ends of the scroll wraps into the alternatively open and closed first chamber formed by the scroll wraps.

20 Claims, 3 Drawing Sheets

CO-ROTATIONAL SCROLL APPARATUS WITH POSITIVE LUBRICANT FLOW

TECHNICAL FIELD

This invention generally pertains to scroll apparatus and specifically to co-rotating scroll-type fluid apparatus having means for ensuring positive flow of lubricant through the scroll wraps and to the scroll member bearings.

BACKGROUND ART

Scroll apparatus for fluid compression or expansion are typically comprised of two upstanding interfitting involute spirodal wraps which are generated about respective axes. Each respective involute wrap is mounted upon an end plate and has a tip disposed in contact or near-contact with the end plate of the other respective scroll wrap. Each scroll wrap further has flank surfaces which adjoin in moving line contact, or near contact, the flank surfaces of the other respective scroll wrap to form a plurality of moving chambers. Depending upon the relative orbital motion of the scroll wraps, the chambers move from the radially exterior end of the scroll wraps to the radially interior ends of the scroll wraps for fluid compression, or from the radially interior end of the respective scroll wraps for fluid expansion. The scroll wraps, to accomplish the formation of the chambers, are put in relative orbital motion by a drive mechanism which constrains the scrolls to non-rotational relative motion. The general principles of scroll wrap generation and operation are discussed in numerous patents, such as U.S. Pat. No. 801,182.

Numerous attempts have been made to develop co-rotational scroll apparatus. Such apparatus provides for concurrent rotary motion of both scroll wraps on parallel, offset axis to generate the requisite orbital motion between the respective scroll wrap elements. However, most commercially successful scroll apparatus to date have been of the fixed scroll-orbiting scroll type due to various difficulties in achieving success with co-rotating scroll apparatus.

In addition to the energy consumed by the additional bearing surfaces typically found, other energy losses can occur. As the scrolls rotate, fluid around and in the vicinity of the scrolls is "fanned" by the scroll members. After the scrolls have been rotating for a period of time, the fluid adjacent the scrolls develops a swirling or centrifugal flow field around the periphery of the scrolls due to the motion of the scroll members. This presents a substantial difficulty when the scroll members are contained in a shell or enclosure. The flow field thus developed increases the total energy requirement for the scroll apparatus, since both the scrolls and the fluid are rotated, and the overall efficiency of the scroll apparatus is reduced.

It has also been difficult to obtain and control adequate lubricant flow through the scroll wraps of a co-rotational scroll apparatus. In many applications such as refrigeration and air conditioning, the scroll apparatus is employed as a gas compressor in a closed circuit system. Lubrication of the compressor in such systems is typically accomplished by providing a lubricant which is miscible in the gas to be compressed, and circulating all or a portion of this lubricant in the closed system. The effect of the centrifugal flow field is to precipitate this miscible lubricant out of the gas, leaving effectively no lubricant available to flow through the scroll wraps of the scroll apparatus and filling the container in which the scrolls rotate with lubricant. This lubricant accumulating in the container also tends to be swirled by the scrolls, requiring additional energy input to the scrolls.

In certain co-rotational scroll apparatus, lubricant is also provided to the bearings supporting the scroll elements. This lubricant also contributes to the lubricant accumulation in the container as it flows from the bearings after having lubricated them.

Therefore it is an object of the present invention to provide a co-rotational scroll apparatus which is efficient in operation.

It is another object of the present invention to provide such a scroll apparatus as will be suitable for use in closed circuit systems such as refrigeration systems.

It is yet another object of the present invention to provide a co-rotational scroll apparatus as will maintain a controlled, effective and adequate flow of lubricant therethrough.

It is yet another object of the present invention to provide such a scroll apparatus as will be simple and inexpensive and suitable for mass production.

These and other objects of the present invention will be apparent from the attached drawings and the description of the preferred embodiment that follows hereinbelow.

SUMMARY OF THE INVENTION

The subject invention is a co-rotational scroll apparatus having two concurrently rotating scroll elements acting as a compressor, each having a scroll wrap thereon for interleaving engagement with the other respective scroll wrap. The scroll elements operate in a container or shell which is provided with an inlet for fluid and are oriented so that the axes of the scroll elements are generally vertical. One of the scroll elements is provided with passages which communicate through the scroll element to discharge lubricant between the scroll end plates, discharging through outlets or openings adjacent the outer end of the scroll wraps adjacent the point where the scroll wraps form the first compression chamber to provide lubricant to the entire scroll wrap length. The discharge outlets can be disposed in the scroll end plate at any location adjacent the outer ends of the scroll wraps which permit lubricant flow into the first compression chamber as it is formed.

Lubricant is provided to the lubricant passages from a lubricant gallery in the shaft of the scroll member. A lubricant pump in the end of the shaft is exposed to a low-pressure sump adjacent the end of the scroll member shaft. The sump is generally at the lowest point in the scroll apparatus so that lubricant in the space containing the scroll members tends to collect in the sump. The lubricant pump provides a positive flow of lubricant from the sump into the lubricant gallery and hence into the lubricant passages. This positive flow ensures a desirable lubricant flow to the scroll wraps and also limits the amount of lubricant accumulation in the sump.

In co-rotational scroll apparatus having lubricated bearings, additional lubricant may be provided to the bearing of the scroll member in which the lubricant gallery is disposed. This is accomplished through lubricant feed passages in the shaft of the scroll member, permitting a metered flow of lubricant through the shaft to the bearing supporting the shaft.

DESCRIPTION OF THE PREFERRED EMBODIMENT

Figure 1:
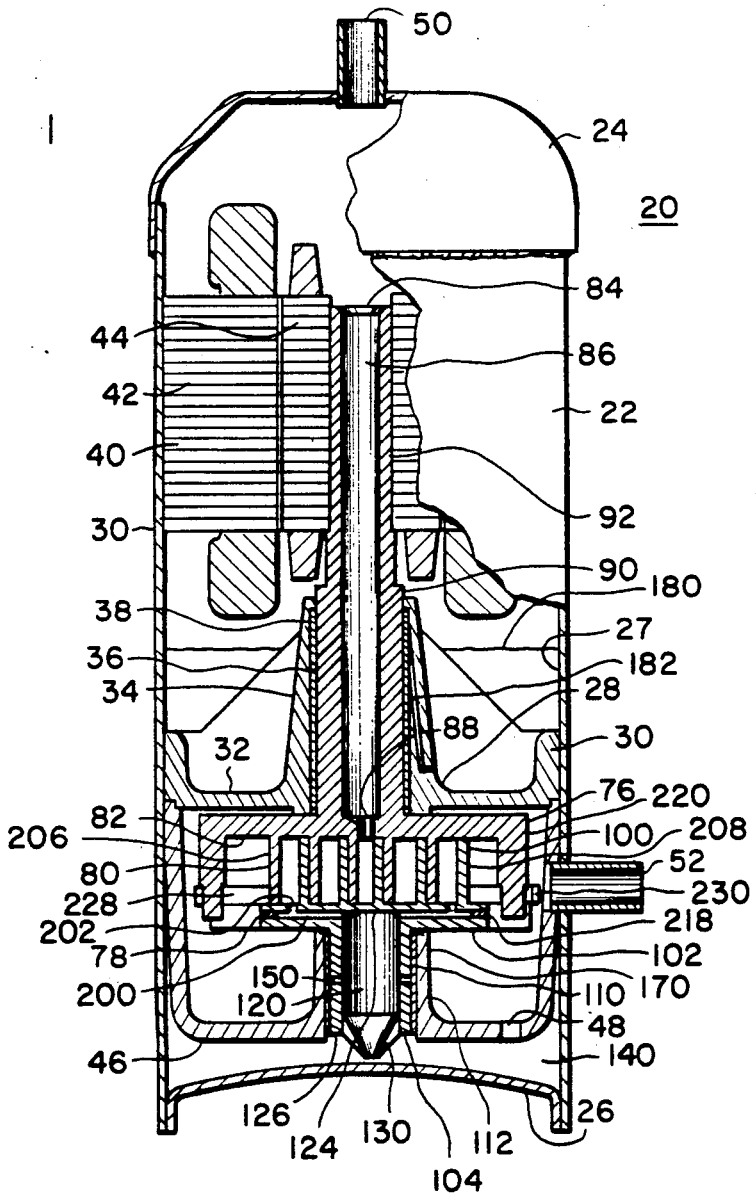
FIG. 1 shows a cross-sectional view of a co-rotational scroll apparatus embodying the subject invention.

A scroll type fluid apparats generally shown in FIG. 1 as a scroll compressor assembly is referred to by reference numeral 20. As the preferred embodiment of the subject invention is a hermetic scroll compressor assembly, the scroll compressor assembly is shown and described as a hermetic scroll compressor assembly. The scroll compressor assembly 20 is interchangeably referred to as a scroll apparatus or as a compressor assembly 20. It will be readily apparent to those skilled in the art that the features of the subject invention may readily be employed in scroll apparatus which are used as fluid pumps or expanders, and in scroll apparatus which are not of the hermetic type.

In the preferred embodiment, the compressor assembly 20 includes a hermetic shell 22 having an upper portion 24, a lower portion 26, and a central exterior shell portion 27, in which is affixed an intermediate, central frame portion 28. The central frame portion 28 is defined by a generally cylindrical or annular exterior portion 30 and a central portion 32 disposed across one end thereof. The annular exterior portion 30 of the central frame portion 28 is sized to sealingly fit within the central exterior shell 27 so that it mat be mated thereto by a press fit, by welding, or by other suitable means.

Integral with the central frame portion 28 is a generally cylindrical upper bearing housing 34, which is substantially coaxial with the axis of the annular exterior portion 30. A drive shaft aperture 36 extends axially through the center of the upper bearing housing 34, and an upper main bearing 38 is disposed radially within the drive shaft receiving aperture 36. Preferably, the upper main bearing 38 is a rotation bearing or journal made, for example, of sintered bronze or similar material. The upper main bearing 38 may also be of the roller or ball bearing type.

A motor 40 is disposed within the upper portion 24 and central exterior shell 27 of the hermetic shell 22. The motor 40 is preferably a single phase or three phase electric motor comprised of a stator 42 which is circumferentially disposed about a rotor 44, with an annular space therebetween permitting free rotation of the rotor 44 within the stator 42 as well as the flow of lubricant or refrigerant fluid. The stator 42 may be affixed within the central exterior shell 27 by press fit therebetween, by a plurality of bolts or screws (not shown), by weldments between appropriate mounting surfaces on the stator 42 and the central exterior shell 27 (not shown), or by other means. It will be readily apparent to those skilled in the art that alternative types of motors 40 and means of mounting the motor 40, and alternative types of drive means, would be equally suitable for application in the subject invention.

Figure 2:
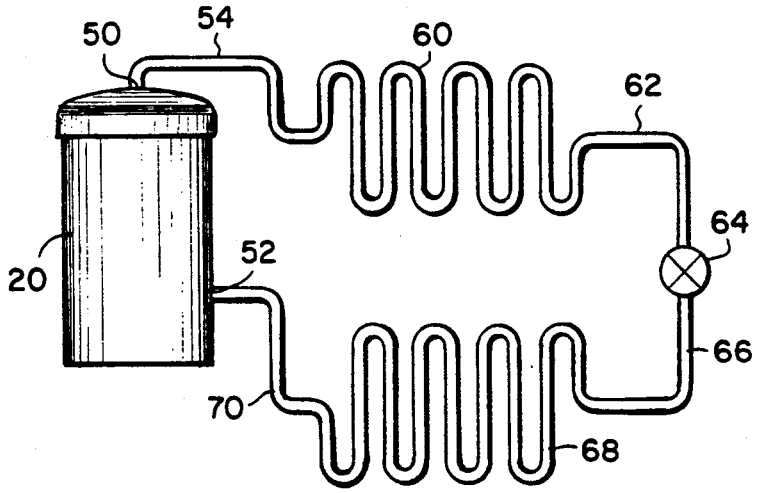
FIG. 2 shows in schematic a closed circuit system such as a refrigeration or air conditioning system in which the subject invention could suitably be employed.

A discharge aperture 50 is shown in the upper shell portion 24 for discharging high pressure fluid from the scroll apparatus 20, and a shell suction aperture 52 is shown disposed in the central exterior shell 27 for receiving low pressure fluid into the scroll apparatus 20. This permits connection of the scroll apparatus 20 to a suitable fluid system. Preferably, the scroll compressor apparatus 20 would be connected to a refrigeration or air conditioning system. Such a system is shown generally in schematic representation in FIG. 2. The representative system includes a discharge line 54 connected between the shell discharge aperture 50 and a condenser 60 for expelling heat from the refrigeration system and condensing the refrigerant. A line 62 connects the condenser to an expansion device 64. The expansion device may be a thermally actuated or an electrically actuated valve controlled by a suitable controller (not shown), or may be one or more capillary tubes. Another line 66 connects the expansion device 64 to an evaporator 68 for transferring expanded refrigerant from the expansion device 64 to the evaporator 68 for acceptance of heat. Finally, a refrigeration system suction line 70 transfers the evaporated refrigerant from the evaporator 68 to the compressor assembly 70, wherein the refrigerant is compressed and returned to the refrigeration system.

It is believed that the general principles of refrigeration systems capable of using such a compressor system 20 are well understood in the art, and that detailed explanation of the devices and mechanisms suitable for constructing such a refrigeration system need not be discussed in detail herein. It is believed that it will also be apparent to those skilled in the art that such a refrigeration or air conditioning system may include multiple units of the compressor assembly 20 in parallel or series connections, as well as multiple condensers or evaporators and other components, hence such embodiments of refrigeration systems need not be discussed here in detail.

Having described the general construction of the compressor assembly 20, the features of the present invention are now described in more detail. Referring again to FIG. 1 and more particularly to FIG. 3, a scroll apparatus having a drive scroll member, arbitrarily designated the first scroll member 76, and an idler scroll member, arbitrarily designated the second scroll member 78, is disclosed. The first scroll member 76 includes an upstanding first involute scroll wrap 80 which is integral with a generally planar drive scroll end plate 82. The drive scroll end plate 82 includes a generally centrally disposed first scroll member drive shaft 84 extending oppositely from the upstanding involute scroll wrap 80. A discharge gallery 86 is defined by a bore extending through the axis of the drive shaft 84. The discharge gallery 86 is in flow communication with a discharge aperture 88 defined by a generally central bore through the drive scroll end plate 82. The drive shaft 84 includes a first, relatively larger diameter bearing portion 90 extending axially through the upper main bearing 38 for a free rotational fit therein, and a second relatively smaller diameter rotor portion 92 which extends axially through the rotor 44 and is affixed thereto.

The rotor 44 may be affixed to the rotor portion 92 by such means as a power transmitting key in juxtaposed keyways, a press fit therebetween, or other suitable means.

The second or idler scroll member 78 includes a second, idler scroll wrap 100 which is disposed in interfitting and interleaving engagement with the first scroll wrap 80. The second scroll member 78 also includes a substantially planar second or idler end plate 102. The idler scroll wrap 100 is generally an upstanding involute extending from the idler end plate 102. A second scroll shaft or idler shaft stub 104 extends from the idler end plate 102 oppositely from the idler scroll wrap portion 100.

A lower main bearing support member 46 is provided in the central shell 27 between the central frame 28 and the base portion 26 for supporting the second scroll member 78. An annular bearing 110, which may he a sleeve hearing made of sintered bronze material, for example, or may be of the roller or ball type, is disposed within an annular wall defining a second shaft or idler bearing housing 112. The second shaft bearing housing 112 is preferably integral with the lower main bearing support 46 for rotationally supporting the second scroll member 78. Apertures 48 are provided in the lower bearing support 46 to permit flow communication through the lower bearing support 46.

The idler shaft stub 104 is preferably annular, having a hollow interior defining a lubricant gallery 120 which is cylindrical. The gallery 120 is defined by the cylindrical outer wall 122, a planar upper surface 124 and the lower end 126 of the shaft 104. While the preferred shape of the lubricant gallery 120 is cylindrical, it would be possible to provide grooves (not shown) or other alterations to enhance control of the lubricant within gallery 120.

A lubricant pump 130 is disposed at or adjacent the lower end 126 of the idler scroll shaft 104. Preferably the pump 130 is a centrifugal pump having an angled inner wall 132 for imparting centrifugal energy to lubricant entering through the intake aperture 134, and thereby functioning as a pumping means for ensuring a positive flow of lubricant into the lubricant gallery 120 during operation of the scroll apparatus 20.

Figure 3:
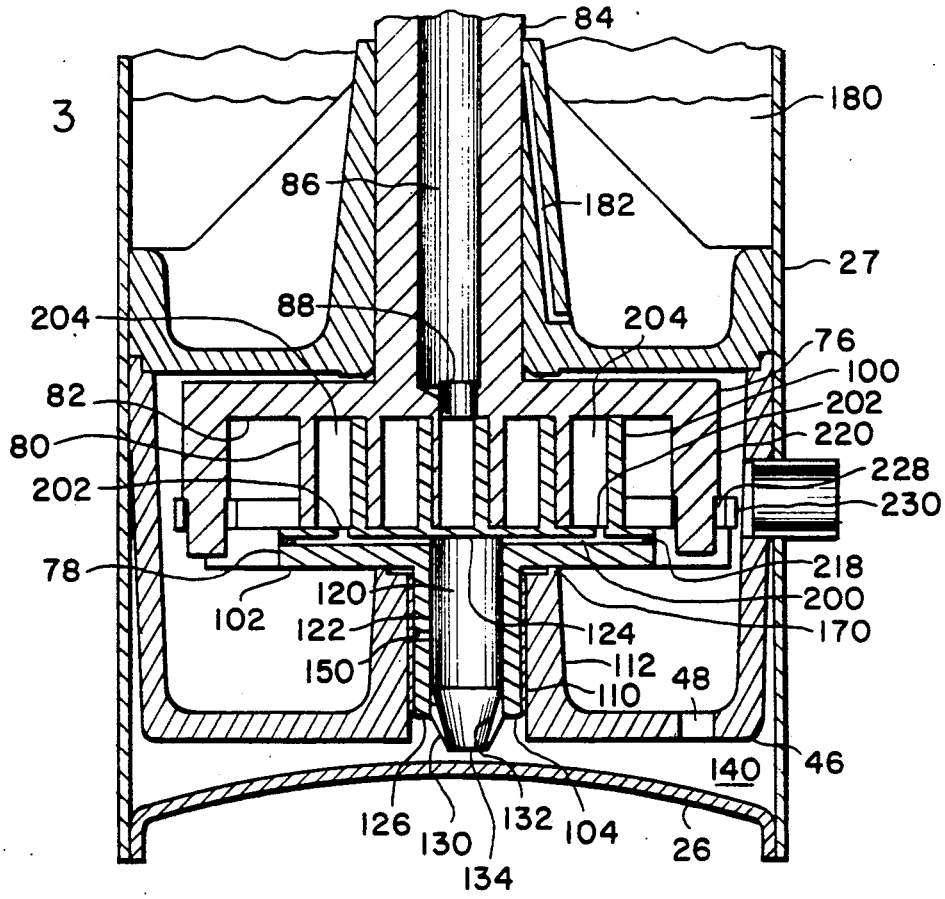
FIG. 3 shows an enlarged partial cross-sectional view of the scroll apparatus of FIG. 1.

A sump 140 for containing a reservoir of accumulated lubricant is defined by the lower part of the central exterior shell 27 and the base portion 26 of the hermetic shell 22. The base portion is preferably dome-shaped, as shown in FIGS. 1 and 3 to provide both additional strength to resist pressure contained within the hermetic shell 22 and also to permit the settling of any debris contained within fluids in the sump 140 around the perimeter of the sump 140 rather than near the center thereof, and therefore away from the pump 130. This minimizes the chances that any such debris would be brought into the gallery 120 by the action of the pump 130.

A means for baffling the lubricant contained in the sump 140 ensures that the lubricant is quiesent, so that foaming of the lubricant is minimized and the settling of debris in the sump 140 is enhanced. According to the preferred embodiment, the lower main bearing support 46 also serves as means for baffling the lubricant contained in the sump 140. However, those skilled in the art will recognize that a separate baffle may be provided which would be equally suitable, and that the bearing support member 46 need not therefore also perform as the means to baffle the lubricant.

In the preferred embodiment, a bearing feed passage 150 extends through the idler scroll shaft 104 to provide lubricant flow from the lubricant gallery 120 to the bearing 110. The bearing feed passage 150 is sized to control the volume of lubricant flow to the bearing 110 to ensure proper lubrication according to the size and material used in the bearing 110 of the particular scroll apparatus 20. As shown, the bearing feed passage 150 is located approximately midway between the upper surface 124 and the lower end 126 of the gallery 120 for an evenly proportioned flow of lubricant along the idler scroll bearing 110.

The upper shoulder 170 of the lower bearing housing 112 serves as an annular thrust bearing for accepting the weight of the first and second scroll members 76 and 78 as well as the drive shaft 90 and the rotor 44. It will be appreciated by those skilled in the art that it is desirable to maintain a vertical or near vertical position (for example, within 45 degrees of vertical) so that the mass of the rotor 44 and the scrolls 76 and 78 will bias the second scroll member 78 against the thrust bearing 170.

Finally, a reservoir 180 for containing lubricant is provided in the central portion 32 of the frame portion 28. The lubricant therein is provided to the upper main bearing 38 through an upper bearing lubricant bore 182 in the upper bearing housing 34. The upper main bearing 38 is sized with respect to the drive shaft 84 so that the flow of lubricant discharged into the sump 140 is controlled in quantity.

A lubricant passage 200 extends radially outward in the second scroll end plate 102. The lubricant passage 200 is in flow connection with the lubricant gallery 120 adjacent the upper surface 124. A lubricant passage outlet 202 permits fluid flow from the lubricant passage 200 to the first chamber 204 formed by the outer ends 206 and 208 of the scroll wraps 76 and 78, respectively. It will be noted that while the first chamber 204 in a compression device is a compression chamber, the first chamber 204 is in fact also a suction chamber since it is open to suction pressure during at least a portion of the rotation of the scroll apparatus, so that the term is used interchangeably herein.

A plug 218 is provided in the outer radial end of the lubricant passage 200. This plug 218 is necessitated by the fact that the lubricant passage 200 as shown is drilled into the second scroll end plate 102. Alternative means of constructing the second scroll end plate 102 might render the plug 218 unnecessary, as the passage 200 would be fully contained within the second scroll end plate 102. Those skilled in the art will recognize that alternative means of forming the passage 200 or of replacing the plug 218 are available.

It will also be appreciated by those skilled in the art that while two radially opposed lubricant passages 200 are shown in the second scroll end plate 102 as disclosed, it would be possible to provide one, three, four or more lubricant passages 200, and such passages 200 need not be either radially opposed or equally radially or angularly spaced. Therefore, the provision of two lubricant passages are shown in each embodiment and figure of the specification for descriptive purposes only.

The scroll apparatus 20 is shown in FIGS. 1 and 3 with an interconnecting drive means between the first scroll member 76 and the second scroll member 78. The drive means includes two radially opposed drive keys 220 extending from the drive scroll end plate 82 and two radially opposed idler keys (not shown). The drive keys 220 and the idler keys are disposed at 90 degree intervals about the axis of the scroll members for sliding engagement drive slots 228 in a drive coupling 230, assuring concurrent rotation of the scroll members 76 and 78. Those skilled in the art will recognize that there are several alternative means of causing concurrent rotation between the first scroll member 76 and second scroll member 78 are readily available. These include the use of flexible members affixed to the respective scroll end plates or the provision of gears and shafts in engagement with each scroll member. As there are various equally suitable alternative drive means for rendering operational the co-rotational scroll apparatus 20, no further discussion of any particular drive means is believed to be necessary herein and the inclusion of a drive means in the scroll apparatus 20 is indicated in FIGS. 4 and 5 by the linked arrows D.

It should be noted that when the same item or feature is shown in more than one of the figures, it will be labeled with the corresponding reference numeral to aid in the understanding of the subject invention. Furthermore, reference should be had to all of the figures necessary to aid in the understanding of the specification even where a particular figure is referred to, as all reference numerals are not displayed in all figures in order to minimize confusion and aid in clarifying the subject invention. When the same item or feature does appear in a figure representing or disclosing an alternative embodiment of that part or feature, it is again labeled with the same reference numeral, followed by a numeric suffix to correspond with the designation of that alternative embodiment in the specification. The numeric designation of the alternative embodiment does not correspond to its preference but rather is intended to aid in the understanding of the subject invention.

Figure 4:
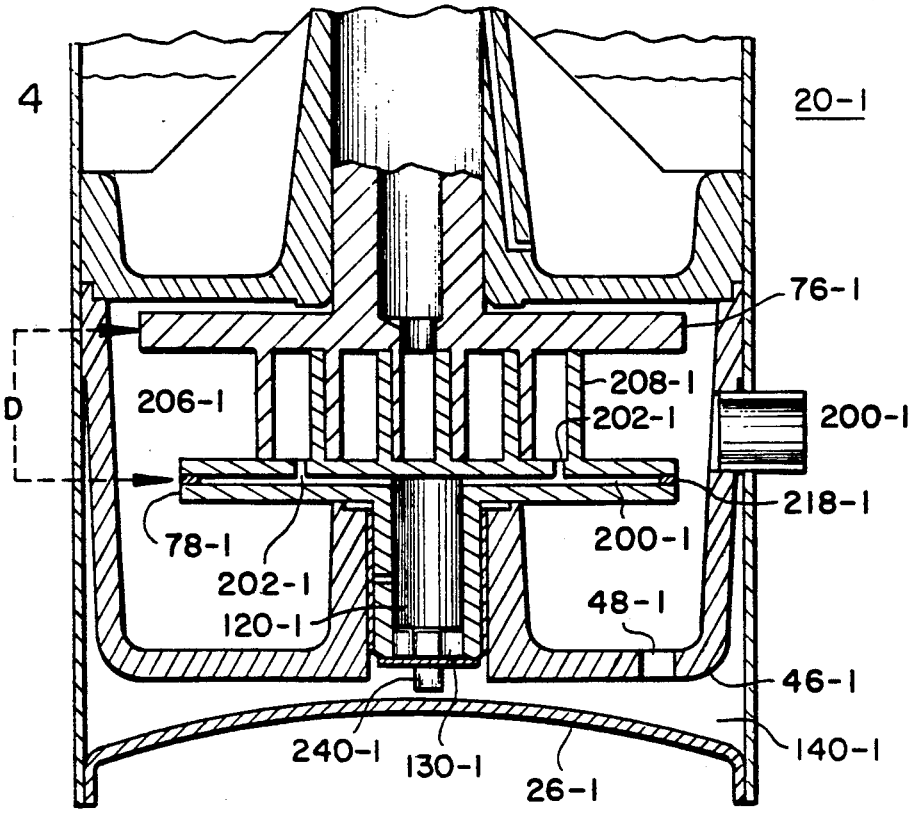
FIG. 4 shows an enlarged partial cross-sectional view of a first alternative embodiment of the scroll apparatus embodying the subject invention.

Turning now to FIG. 4, an alternative embodiment of the scroll apparatus 20-1 is shown in which a positive displacement pump 130-1 is provided in lieu of the centrifugal pump 130 of the preferred embodiment. A positive displacement pump 130-1 provides the advantage of positive lubricant flow in a scroll apparatus 20-1 operating at a relatively low rotational speed, or where the scroll apparatus 20-1 operates over a wide range of speeds. The positive displacement pump 130-1 is also provided with a lubricant inlet tube 240-1 which extends into the sump 140-1 to ensure a flow of lubricant into the pump 130-1. While the preferred type of positive displacement pump 130-1 would be an internal gear pump, there are several types of positive displacement pumps 130-1 which are suitable for shaft end application. Internal gear pumps and other such suitable pumps 130-1 are believed to be well known in the art and no extensive discussion is believed to be necessary herein.

Figure 5:
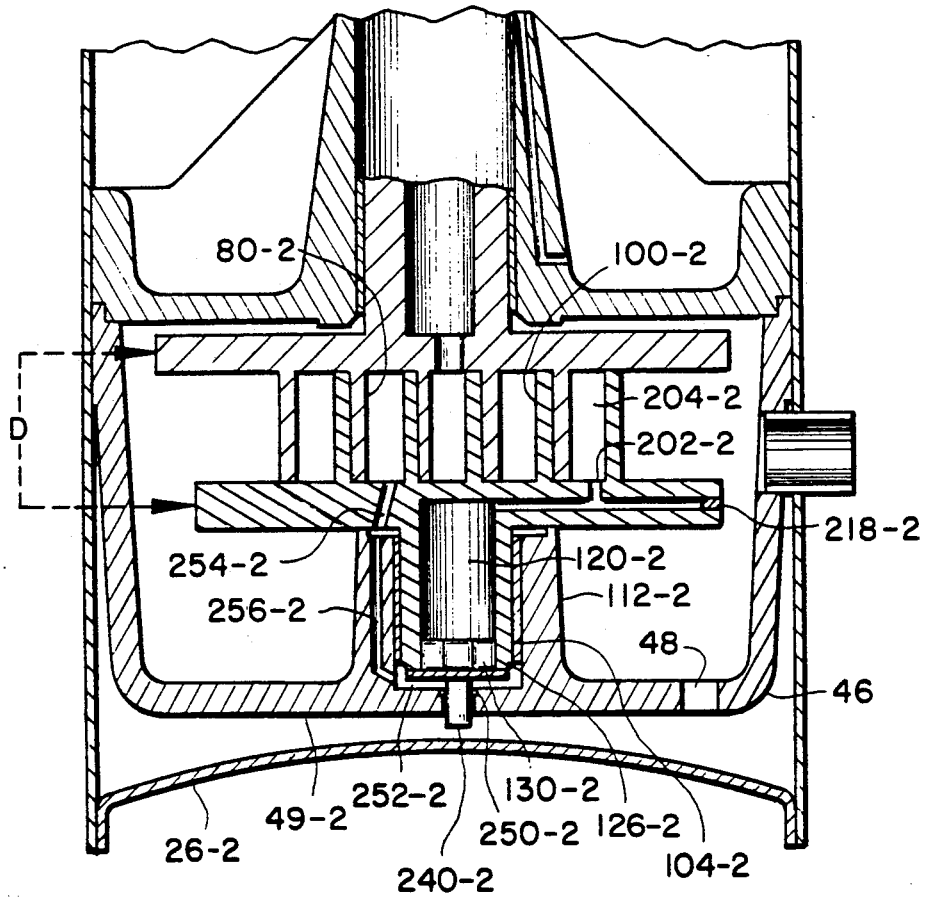
FIG. 5 shows an enlarged partial cross-sectional view of a second alternative embodiment of the scroll apparatus embodying the subject invention.

In FIG. 5, a positive displacement pump 130-2 as shown in FIG. 4 is provided. In this alternative embodiment, a bearing housing floor 49-2 is provided to enclose or substanially enclose the lower end 126-2 of the idler scroll shaft 104-2, and a pressure seal 250-2 is provided between the bearing housing floor 49-2 and the lubricant inlet tube 240-2 to prevent an exchange of fluid from the pressure balance chamber 252-2 thus formed between the idler scroll shaft lower end 126-2 and the lower bearing housing 112-2. The pressure seal 250-2 seals an aperture in the bearing housing floor 49-2 to permit the lubricant inlet tube 240-2 to extend into the sump 140-2 and withdraw the lubricant therefrom. A pressure bleed passage 254-2 in the second scroll end plate 102-2 permits the flow of pressurized fluid from one of the chambers formed by the scroll wraps 80-2 and 100-2 into the chamber 252-2 by way of a passage 256-2 in the lower bearing housing 112-2 so that the pressurized fluid may act upon the idler scroll shaft 104-2 to provide a pressure biasing force upon the drive scroll 76-2.

The operation of either of the above described alternative embodiments of the scroll apparatus 20 is substantially similar to that of the preferred embodiment, described below, and no separate description is believed necessary.

Returning again to FIGS. 1 and 3 for reference, the operation of the exemplary scroll apparatus 20 can be described. In operation, the motor 40 of the compressor assembly 20 is connected to an appropriate electrical supply (not shown) and actuated to cause rotation of the rotor 44. The rotor 44 in turn rotates the drive shaft 84, driving the driven end plate 82. The drive means D causes the concurrent rotation of the lower or second scroll element 78. Because the axis of the first scroll member 76 and the second scroll member 78 are not aligned, a relative orbital motion is set up between the driven scroll wrap 80 and the idler scroll wrap 100, causing a plurality of chambers to be formed, with the first chamber as defined by the outer scroll portions 206 and 208 to form a first chamber which is alternatively open to the suction space and closed therefrom to be formed. The chambers thus formed are of decreasing volume toward the radially inward ends of the respective scroll wraps 80 and 100, such that fluid drawn into the first chamber is compressed as it is moved toward the radially inward ends of the respective scroll wraps 80 and 100.

The compressed fluid is then discharged from the scroll wraps 80 and 100 through the discharge aperture 88 into the discharge gallery 86 and thereafter into the discharge pressure portion of the hermetic shell 22 defined in the upper shell portion 24.

Lubricant separated from inlet suction fluid flows into the sump 140 and accumulates therein with that discharged from the upper main bearing 38. Lubricant accumulating within the sump 140 is forced into the lubricant gallery 120 by the pump 130. The centrifugal pump 130 maintains a positive flow of lubricant into the gallery 120 as long as the scroll apparatus 20 is in operation.

Lubrication of the lower main bearing 110 occurs after operation of the scroll apparatus 20 has started and the lubricant level in the lubricant gallery 120 has reached the bearing feed passages 150, with lubricant flowing therethrough to the idler bearing 110.

Those skilled in the art will appreciate the fact that the lubricant pump 130 will maintain the level of lubricant in the sump 140 at a desired level, preventing an undesirable accumulation of fluid, whether the fluid is lubricant alone or condensed from the gases to be compressed or other unpumped fluid. The various lubricant passages 200 provide the desired effect of maintaining adequate lubrication of the scroll wraps 80 and 100 without undue consumption of power in the pumping of lubricant. A positive, adequate flow of lubricant also improves the sealing of the chambers of the scroll apparatus, providing an additional performance benefit. Furthermore, the subject invention is readily implemented in the scroll apparatus 20 without substantial modification thereto, while the provision of constant, positive lubrication prevents unnecessary wear in the scroll wraps and assures adequate lubrication reducing unnecessary wear and potential requirements for maintenance in the compressor assembly 20. It will be appreciated, therefore, that the compressor assembly 20 has both improved reliability and efficiency.

Modifications to the preferred and alternate embodiments of the subject invention will be apparent to those skilled in the art within the scope of the claims that follow hereinbelow.

What is claimed is:

1. A scroll apparatus comprised of:

a shell defining a suction pressure portion and a sump, said sump being disposed in said suction pressure portion;

a first scroll member disposed in said suction pressure portion, said first scroll member having a first scroll end plate, a first scroll shaft and an oppositely directed first scroll wrap disposed on said first scroll end plate;

a second scroll member disposed in said suction pressure portion, said second scroll member having a second scroll end plate, a second scroll shaft, and an oppositely directed second scroll wrap disposed thereon in interleaving engagement with said first scroll wrap, said second scroll wrap cooperating with said first scroll wrap to form an alternatively open and closed first chamber, said second scroll end plate defining a lubricant passage and said second scroll shaft defining a lubricant gallery, said lubricant passage being in flow communication with both said gallery and said first chamber;

means for pumping lubricant from said sump to said lubricant gallery, said pumping means disposed in said second scroll shaft; and means for concurrently rotating said first and second scroll members.

2. The scroll apparatus as set forth in claim 1 wherein said shell further includes a bearing support member for supporting said second scroll member shaft and baffling said sump so that the lubricant in said sump is quiescent.

3. The scroll apparatus as set forth in claim 2 wherein said bearing support further includes a bearing disposed in said bearing support for providing rotational support to said second scroll member.

4. The scroll apparatus as set forth in claim 3 wherein said second scroll shaft further defines a bearing feed passage in flow communication with said lubricant gallery and said bearing for permitting flow of the lubricant to said bearing.

5. The scroll apparatus as set forth in claim 4 wherein said shell further includes a portion in said sump for permitting the settling of debris from the lubricant away from said pumping means.

6. The scroll apparatus as set forth in claim 1 wherein said pumping means is a centrifugal pump.

7. A scroll compressor apparatus comprised of:

a hermetic shell, said shell defining a suction pressure portion, a discharge pressure portion and a sump, said sump being disposed in said suction pressure portion of said shell;

a first scroll member disposed in said suction pressure portion, said first scroll member having a first scroll end plate, a first scroll shaft, and an oppositely directed first scroll wrap disposed on said first scroll end plate;

a second scroll member disposed in said suction pressure portion, said second scroll member having a second scroll end plate, a second scroll shaft, and an oppositely directed second scroll wrap disposed thereon in interleaving engagement with said first scroll wrap, said second scroll wrap cooperating with said first scroll wrap to form an alternatively open and closed first compression chamber, said second scroll shaft defining a gallery and said second scroll end plate defining a lubricant passage, said lubricant passage being in flow communication with said first compression chamber and said gallery;

means for pumping lubricant from said sump to said lubricant gallery, said pumping means being disposed in said second scroll shaft;

a bearing support member in said suction portion;

bearing means disposed in said bearing support member for rotatably supporting said second scroll member;

a bearing feed passage defined in said second scroll shaft, said bearing feed passage being in flow communication with said lubricant gallery and said bearing for permitting flow of lubricant to said bearing;

a motor driveably connected to said first scroll member shaft for rotating said first scroll member; and means for concurrently rotating said second scroll member with said first scroll member.

8. The scroll apparatus as set forth in claim 7 wherein said scroll apparatus further includes a bearing feed passage defined in said second scroll shaft, said bearing feed passage in flow communication with said lubricant gallery and said bearing for permitting flow of the lubricant to said bearing.

9. The scroll apparatus as set forth in claim 7 wherein said shell has a base portion, said scroll apparatus further comprising baffle means for shielding lubricant in said sump, said base portion having a perimeter area for permitting the setting of debris from the lubricant.

10. The scroll apparatus as set forth in claim 7 wherein said pumping means is a centrifugal pump.

11. The scroll apparatus as set forth in claim 7 wherein said pumping means further includes a lubricant inlet tube extending from said pumping means into said sump.

12. The scroll apparatus as set forth in claim 11 wherein said second scroll shaft has a lower end and said bearing support member further includes:

a bearing housing floor substantially enclosing said lower end of said second scroll shaft; and a pressure seal disposed between said bearing housing floor and said lubricant inlet tube, whereby said bearing support member and said second scroll shaft define a pressure balance chamber, said pressure balance chamber being in flow communication with a compression chamber defined by said first and second scroll wraps which is other than said first compression chamber so that when said compressor is in operation a pressurized fluid passes from said compressor chamber which is other than said first compression chamber, through said passes and into said pressure balance chamber to provide a pressure biasing force which acts on said second scroll member.

13. The scroll apparatus as set forth in claim 12 wherein said second scroll end plate defines a pressure bleed passage in flow communication with said pressure balance chamber.

14. A refrigeration system for circulating refrigerant in closed loop connection comprised of:

a condenser for condensing refrigerant to liquid form;

an expansion device for receiving liquid refrigerant from said condenser and expanding the refrigerant;

an evaporator for receiving the refrigerant from said expansion device and evaporating the refrigerant to vapor form;

a compressor for receiving the refrigerant from the evaporator, compressing the refrigerant, and sending the refrigerant to the condenser, said compressor having (i) a hermetic shell defining a suction pressure portion, a discharge pressure portion and a sump;

(ii) a first scroll member disposed in said suction pressure portion, said first scroll member having a first scroll end plate, a first scroll shaft, and an oppositely directed first scroll wrap disposed on said first scroll end plate;

(iii) a second scroll member disposed in said suction pressure portion, said second scroll member having a second scroll end plate, a second scroll shaft, and an oppositely directly second scroll wrap disposed thereon in interleaving engagement with said first scroll wrap, said second scroll wrap cooperating with said first scroll wrap to form a cyclically open and closed first compression chamber between the respective scroll wraps when said compressor is in operation, said second scroll shaft defining a gallery and said second scroll end plate defining a lubricant passage in flow communication with both said first compression chamber and said gallery;

(iv) means for pumping lubricant from said sump to said lubricant gallery, said pumping means disposed in said second scroll shaft;

(v) a bearing support member in said suction portion of said hermetic shell for supporting said second scroll member;

(vi) bearing means for rotatably supporting said second scroll member in said bearing support member;

(vii) a motor driveably connected to said first scroll member shaft for rotating said first scroll member; and (viii) means for concurrently rotating said second scroll member with said first scroll member.

15. The refrigeration system as set forth in claim 14 wherein said compressor further includes a bearing feed passage defined in said second scroll shaft, said bearing feed passage in flow communication with said lubricant gallery said bearing for permitting flow of the lubricant to said bearing.

16. The refrigeration system as set forth in claim 14 wherein said compressor shell and includes baffle means for maintaining lubricant in said sump quiescent and a base portion which defines a perimeter area in said sump for permitting the settling of debris from the lubricant, said perimeter area being remote from said means for pumping lubricant.

17. The refrigeration system as set forth in claim 15 wherein said pumping means is a centrifugal pump.

18. The refrigeration system as set forth in claim 14 wherein said pumping means further includes a lubricant inlet tube extending from said pumping means into said pump.

19. The refrigeration system as set forth in claim 18 wherein said second scroll shaft has a lower end and wherein said bearing support member further includes:

a bearing housing floor substantially enclosing said lower end of said second scroll shaft; and a pressure seal disposed between said bearing housing floor and said lubricant inlet tube, whereby said bearing support member and said second scroll shaft cooperate to define a pressure balance chamber, said pressure balance chamber being in flow communication with a compression chamber defined between said first and said second scroll wraps which is other than said first compression chamber so that pressurized fluid at an elevated pressure is communicated to said pressure balance chamber to pressure bias said second scroll member when said compressor is in operation.

20. The refrigeration system as set forth in claim 19 wherein said second scroll end plate defines a pressure bleed passage for providing said pressurized fluid from said compression chamber which is other than said first compression chamber.

* * * * *

UNITED STATES PATENT AND TRADEMARK OFFICE

CERTIFICATE OF CORRECTION

PATENT NO. : 5,101,644

DATED : April 7, 1992

INVENTOR(S) : Daniel R. Crum, Peter A. Kotlarek and Robert E. Utter

It is certified that error appears in the above-identified patent and that said Letters Patent is hereby corrected as shown below:

Column 3, Line 22, "apparats" should read --apparatus--.

Column 3, Line 44 "mat" should read --may--.

Column 5, Line 18, "he" should read --be--.

Column 5, Line 19, "hearing" should read --bearing--.

In The Claims:

Claim 12, Column 10, Line 58, "passes" should read --passage--.

Claim 16, Column 12, Line 10, delete the word "and".

Column 12, line 16, "claim 15" should read --claim 14--.

Claim 18, Column 12, Line 21, "pump" should read --sump--.

Claim 20, Column 12, Line 43, after the word "chamber" insert --to said pressure balance chamber--.

Signed and Sealed this

Twenty-second Day of June, 1993

*Attest:*

Michael K. Kirk

MICHAEL K. KIRK

*Attesting Officer*

*Acting Commissioner of Patents and Trademarks*